US010744526B2

(12) United States Patent
Johnson

(10) Patent No.: US 10,744,526 B2
(45) Date of Patent: Aug. 18, 2020

(54) STAND FOR ONE OR MORE VEHICLE PARTS

(71) Applicant: Innovative Tools & Technologies, Inc., St. Paul, MN (US)

(72) Inventor: Bryan T. Johnson, Vadnais Heights, MN (US)

(73) Assignee: Innovative Tools & Technologies, Inc., St. Paul, MN (US)

( * ) Notice: Subject to any disclaimer, the term of this patent is extended or adjusted under 35 U.S.C. 154(b) by 374 days.

(21) Appl. No.: 14/803,829

(22) Filed: Jul. 20, 2015

(65) Prior Publication Data

US 2016/0023229 A1 Jan. 28, 2016

Related U.S. Application Data

(60) Provisional application No. 62/027,509, filed on Jul. 22, 2014.

(51) Int. Cl.
*B05B 13/02* (2006.01)
*B25H 1/00* (2006.01)

(52) U.S. Cl.
CPC ..... *B05B 13/0285* (2013.01); *B25H 1/00* (2013.01); *B25H 1/0007* (2013.01)

(58) Field of Classification Search
CPC ..... B05B 13/0285; B05B 13/0228; B25H 1/0007; F16M 11/10; F16M 11/16; F16M 11/14; B25B 5/006
USPC .... 269/16, 17, 45, 71, 75; 248/176.1, 176.3, 248/178.1, 276.1, 278.1
See application file for complete search history.

(56) References Cited

U.S. PATENT DOCUMENTS

| | | | | |
|---|---|---|---|---|
| 569,289 | A | 10/1896 | Lynch | |
| 574,529 | A | 1/1897 | Elliott | |
| 653,519 | A | 7/1900 | Masters | |
| 783,031 | A | 2/1905 | Fell | |
| 1,670,253 | A * | 5/1928 | Gilbert | B25B 5/10 164/DIG. 12 |
| 1,833,355 | A | 11/1931 | Dahms | |
| 1,964,626 | A | 6/1934 | Fotakis | |
| 2,324,803 | A | 7/1943 | Snyder | |
| 2,459,080 | A | 1/1949 | Killius | |

(Continued)

OTHER PUBLICATIONS

"The Scissors Stand," datasheet [online]. Collision Services, Inc. Website copyright date: 2003. Particular website page copyright date: Unknown. Retrieved on Mar. 2, 2009 from the Internet: URL:http:www.collisionservices.com/acb/showdetl.cfm?&User_ID=744682&St=4691&St2=46838205&St3=31124990&DS_ID=3&Product_ID=360&DID=7; 2 pgs.

(Continued)

*Primary Examiner* — Orlando E Aviles
*Assistant Examiner* — Seahee Yoon
(74) *Attorney, Agent, or Firm* — Mueting Raasch Group

(57) ABSTRACT

A stand for receiving an object, e.g., an automobile panel, may include a base support configured to engage a ground surface, an upright support extending upward from the base support, and one or more object coupling apparatus. For example, the object coupling apparatus may include an upper support element coupled to the upright support that provides an elongate support element elevated above the ground surface and one or more various arms movable along the elongate support element that couple to the object.

18 Claims, 11 Drawing Sheets

(56) References Cited

U.S. PATENT DOCUMENTS 2,551,753 A * 5/1951 McCullough ..... G03B 15/03 362/239
2,669,958 A * 2/1954 Sweeney ..... B23K 37/0426 269/45
2,793,425 A 5/1957 Koban
2,799,920 A 7/1957 Hansen
2,803,872 A 8/1957 Massa
2,827,690 A * 3/1958 Brown ..... F16M 11/18 269/17
2,879,059 A * 3/1959 Sandefur ..... B25H 1/00 269/17
2,887,974 A 5/1959 Weinfeld
2,976,033 A 3/1961 Martin
2,995,357 A 8/1961 Dennis et al.
3,220,565 A 11/1965 Wells
3,586,278 A * 6/1971 Simons ..... F16M 11/12 248/165
3,595,556 A * 7/1971 Schonauer ..... B25H 1/00 269/21
3,643,935 A 2/1972 Bell
3,858,864 A 1/1975 Waldow
3,891,301 A * 6/1975 Heller ..... F16M 11/08 359/384
4,029,308 A 6/1977 Mathers
4,061,305 A 12/1977 Beekenkamp
4,070,011 A 1/1978 Glesser
4,180,252 A 12/1979 Cushenbery
4,183,511 A 1/1980 Marek
4,221,368 A 9/1980 Channel
4,245,786 A 1/1981 Abrahamsen et al.
4,531,720 A 7/1985 Söder
4,676,491 A 6/1987 Radlof
4,763,865 A 8/1988 Danner
4,771,980 A 9/1988 Dubbs et al.
4,848,759 A 7/1989 Gardner
D303,031 S 8/1989 Ellis
4,880,194 A 11/1989 Geise et al.
4,943,040 A 7/1990 Finstad et al.
4,949,944 A * 8/1990 Groff, Sr. ..... B25B 5/003 269/296
4,974,525 A 12/1990 Sheffield
5,127,359 A 7/1992 Kannarie et al.
5,135,205 A 8/1992 Bédard
5,141,211 A 8/1992 Adams, Jr.
5,259,602 A 11/1993 Rogos
5,294,098 A 3/1994 Bundy
5,296,030 A 3/1994 Young
5,520,292 A * 5/1996 Lombardi ..... A47F 7/00 211/182
5,675,417 A 10/1997 Ventura et al.
5,690,416 A 11/1997 Van Gennep
5,707,450 A 1/1998 Thompson
5,709,373 A 1/1998 Wasylynko
5,720,817 A * 2/1998 Taylor ..... B05B 13/0285 118/500
5,984,245 A 11/1999 Hsu
6,003,830 A 12/1999 Egan
6,024,348 A 1/2000 Ventura et al.
6,138,970 A 10/2000 Sohrt et al.
6,173,947 B1 1/2001 Johnson
6,409,128 B1 6/2002 Deshler
6,491,755 B1 12/2002 Meinke
6,610,916 B1 * 8/2003 Torrez ..... F16M 11/28 84/421
6,837,934 B1 * 1/2005 Patrykus ..... F16M 11/42 118/500
7,237,758 B2 * 7/2007 Nikolic ..... B25H 1/0007 248/127
7,445,184 B1 * 11/2008 Johnson ..... B05B 13/0285 248/176.1
7,448,606 B1 * 11/2008 Johnson ..... B05B 13/0285 269/16
7,988,137 B2 8/2011 Johnson
8,328,173 B1 * 12/2012 DesForge ..... B25B 5/006 248/176.1
8,770,561 B2 * 7/2014 Gagnon, Jr. ..... B25H 1/0007 118/500
2006/0053689 A1 * 3/2006 Smith ..... A01G 9/12 47/45
2006/0113435 A1 * 6/2006 Nikolic ..... B25H 1/0007 248/122.1
2007/0022950 A1 * 2/2007 Livingston ..... B05B 13/0285 118/500
2008/0142652 A1 * 6/2008 Johnson ..... B05B 13/0285 248/176.1
2012/0242022 A1 * 9/2012 Gagnon, Jr. ..... B25B 11/00 269/9
2014/0356049 A1 * 12/2014 Lin ..... B25J 15/0616 403/59

OTHER PUBLICATIONS

"Folding Bench—500 lb." datasheet [online]. Collision Services, Inc. Website copyright date: 2003. Particular website page copyright date: Unknown. URL:http:www.collisionservices.com/acb/showdetl.cfm?&User_ID=744682&St=4691&St2=46838205&St3=31124990&DS_ID=3&Product_ID=360&DID=7; 2 pgs.
"Folding Bench—Lightweight," datasheet [online]. Collision Services, Inc. Website copyright date: 2003. Particular website page copyright date: Unknown. URL:http:www.collisionservices.com/acb/showdetl.cfm&User_ID=744682&St=4691&St2=46838205&St3=31124990&DS_ID=3&Product_ID=360&DID=7; 2 pgs.
Collison Services. Makes Handling Parts a Breeze the Rotomaxx. Aug. 20, 2001.
The Ultimate Auto Body Parts Stand, Kno: Greef MFG. Feb. 2002, Canada.
Tools & Equipment Flex Bench, undated, p. 45 Catalog. Collision Services Nov 4, 2004.

* cited by examiner

STAND FOR ONE OR MORE VEHICLE PARTS

CROSS-REFERENCE TO RELATED APPLICATION

This application claims the benefit of U.S. Provisional Patent Application Ser. No. 62/027,509 filed on Jul. 22, 2014, which is incorporated by reference herein in its entirety.

BACKGROUND

The disclosure herein relates generally to an adjustable stand for receiving one or more objects, e.g., door panels and/or fenders from an automobile, such that a user, e.g., may repair and/or paint the object.

Supporting objects (e.g., automobile panels) for repair and/or to be painted can be difficult. For example, surfaces of objects are often contoured and/or shaped, and as a result, supporting such objects without damaging the objects may be difficult.

SUMMARY

The disclosure herein relates generally to a stand that may receive an object (e.g., a stand for receiving an object to be repaired, a stand for receiving and holding vehicle parts such as doors or fenders, methods relating to use of the stand, etc.).

In one embodiment of a stand, the stand may include a base support configured to engage a ground surface, an upright support extending upward from the base support, and one or more object coupling apparatus. Each object coupling apparatus may include an upper support element coupled to the upright support (e.g., wherein the upper support element may include an elongate support element elevated above the ground surface), first and second support arms movable along the elongate support element elevated above the ground surface (e.g., wherein the first support arm may include at least an arm element terminating a distance from the elongate support element at a coupling element usable to couple the first support arm to a first portion of an object of the one or more objects and wherein the second support arm may include at least an arm element terminating a distance from the elongate support element at a coupling element usable to couple the second support arm to a second portion of the object), and a drop support arm apparatus movable along the elongate support element. The drop support arm apparatus may include a drop arm portion extending in a direction downward toward the ground surface from the elevated elongate support element and a distal coupling element movable to various positions at one or more elevations above the ground surface that are less than an elevation of the coupling element of either the first and second support arms (e.g., the distal coupling element may be usable to couple the drop support arm apparatus to a third portion of the object).

In one or more embodiments of the stand, the drop arm portion may extend at least partially along a drop axis substantially vertical to the ground surface, and further, the distal coupling element may be movable vertically to one or more elevations above the ground surface, movable horizontally along an axis orthogonal to the substantially vertical drop axis, rotatable to one or more positions about the axis orthogonal to the drop axis, and rotatable to one or more positions about the drop axis.

Further, in one or more embodiments of the stand, the drop support arm apparatus may include an attachment portion movable along the elongate support element (e.g., a proximal end of the drop arm portion may be coupled to the attachment portion and extend along a drop axis in a direction downward toward the ground surface from the elevated elongate support element). Further, a coupling arm may be movably coupled to the drop arm portion (e.g., the coupling arm may be movable along the drop axis, rotatable about the drop axis, and movable along and rotatable about an axis orthogonal relative to the drop axis). In one embodiment, the distal coupling element may terminate an end of the coupling arm.

Still further, in one or more embodiments of the stand, at least one of the first and second support arms may include an attachment element movable along an axis of the elongate support element, a first arm element that may include a proximal end coupled to the attachment element and that may extend along the direction of the axis of the elongate support element (e.g., the first arm element may be offset from the elongate support element such that a gap is defined therebetween, wherein the gap may be sized such that the drop support arm apparatus is movable along the elongate support element within the gap), and a second arm element coupled to a distal portion of the first arm element and terminating a distance from the elongate support element at the coupling element usable to couple a support arm to the object. In one embodiment, the second arm element coupled to a distal portion of the first arm element may extend orthogonally therefrom and at an angle upward relative to the axis of the elongate support element.

Yet further, each of the first and second support arms movable along the elongate support element may be removable from at least one of a first and a second end of the elongate support element. Each of the first and second support arms may be positionable on the elongate support element such that at least portions of the first arm element and second arm element extend beyond at least one of the first and second ends of the elongate support element and may also being positionable on the elongate support element such that no portions of the first arm element and second arm element extend beyond the first or second ends of the elongate support element.

In another exemplary embodiment of a stand, the stand may include a base support configured to engage a ground surface, an upright support extending upward from the base support, and one or more object coupling apparatus. Each object coupling apparatus may include an upper support element coupled to the upright support (e.g., wherein the upper support element may include an elongate support element elevated above the ground surface), one or more support arms movable along the elongate support element elevated above the ground surface (e.g., wherein each support arm may include at least a coupling element usable to couple the support arm to a portion of an object of the one or more objects), and a drop support arm apparatus movable along the elongate support element. The drop support arm may include a drop arm portion extending at least partially along a drop axis substantially vertical to the ground surface and a distal coupling element movable vertically to one or more elevations above the ground surface, movable horizontally along an axis orthogonal to the substantially vertical drop axis, rotatable to one or more positions about the axis orthogonal to the drop axis, and rotatable to one or more positions about the drop axis. The distal coupling element may be usable to couple the drop support arm apparatus to another portion of the object.

In one or more embodiments of the stand, the drop support arm apparatus may include an attachment portion movable along the elongate support element (e.g., a proximal end of the drop arm portion may be coupled to the attachment portion and extend along the drop axis in a direction downward toward the ground surface from the elevated elongate support element) and a coupling arm movably coupled to the drop arm portion. For example, the coupling arm may be at least one of movable along the drop axis, rotatable about the drop axis, movable along an axis orthogonal to the drop axis, or rotatable about the axis orthogonal to the drop axis (e.g., the coupling arm may be movable in one or more of such manners, as well as all of such manners). The distal coupling element may terminate an end of the coupling arm.

In one or more embodiments of the stand, at least one of the one or more support arms may include an attachment element movable along an axis of the elongate support element, a first arm element that includes a proximal end coupled to the attachment element and extends along the direction of the axis of the elongate support element (e.g., wherein the first arm element may be offset from the elongate support element such that a gap is defined therebetween, and wherein the gap may be sized such that the drop support arm apparatus is movable along the elongate support element within the gap), and a second arm element coupled to a distal portion of the first arm element and terminating a distance from the elongate support element at the coupling element usable to couple the at least one of the one or more support arms to the object. In one embodiment, the second arm element coupled to a distal portion of the first arm element may extend orthogonally therefrom and at an angle upward relative to the axis of the elongate support element.

In yet another exemplary embodiment of a stand for receiving one or more objects, the stand may include a base support configured to engage a ground surface, an upright support extending upward from the base support, and one or more object coupling apparatus. Each object coupling apparatus may include an upper support element coupled to the upright support (e.g., wherein the upper support element may include an elongate support element elevated above the ground surface), and first and second support arms movable along the elongate support element elevated above the ground surface. Each of the first and second support arms may include an attachment element movable along an axis of the elongate support element and a first arm element that may include a proximal end coupled to the attachment element and may extend along the direction of the axis of the elongate support element. The first arm element may be offset from the elongate support element such that a gap is defined therebetween. The support arms may further include a second arm element coupled to a distal portion of the first arm element and terminating a distance from the elongate support element at a coupling element configured to be coupled to the object. In at least one embodiment thereof, each of the first and second support arms movable along the elongate support element are removable from at least one of a first and second end of the elongate support element, and each of the first and second support arms may be positionable on the elongate support element such that at least portions of the first arm element and second arm element extend beyond at least one of the first and second ends of the elongate support element and also may be positionable on the elongate support element such that no portions of the first arm element and second arm element extend beyond the first or second ends of the elongate support element.

In one or more embodiments of the stand, the object coupling apparatus may further include a drop support arm apparatus movable along the elongate support element and also removable from at least one of the first and second ends of the elongate support element. The drop support arm apparatus may include a distal coupling element movable to various positions at one or more elevations above the ground surface that are less than an elevation of the coupling element of either the first and second support arms (e.g., the distal coupling element of the drop support arm apparatus being usable to couple the drop support arm to another portion of the object). The gap defined by the first arm element being offset from the elongate support element may be sized such that the drop support arm apparatus is movable along the elongate support element within the gap.

Further, in one or more embodiments of the stand, the drop support arm apparatus may include a drop arm portion that extends at least partially along a drop axis substantially vertical to the ground surface, and further, for example, the distal coupling element may be movable vertically to one or more elevations above the ground surface, movable horizontally along an axis orthogonal to the substantially vertical drop axis, rotatable to one or more positions about the axis orthogonal to the drop axis, and rotatable to one or more positions about the drop axis.

Still further, embodiments of the stands herein may include one or more of the following features: the distal coupling element may include a swivel clamp movable in multiple positions with use of a ball and socket; the one or more object coupling apparatus may include first and second object coupling apparatus coupled to the upright support opposite one another (e.g., wherein the first and second object coupling apparatus may be configured to be coupled to first and second objects, respectively); and/or each of the first and second support arms and the drop support arm apparatus movable along the elongate support element may be removable from at least one of a first end and a second end of the elongate support element.

The above summary is not intended to describe each embodiment or every implementation of the stands for receiving objects or methods of using such stands. Advantages, together with a more complete understanding, will become apparent and appreciated by referring to the following detailed description and claims taken in conjunction with the accompanying drawings.

Figure 1:
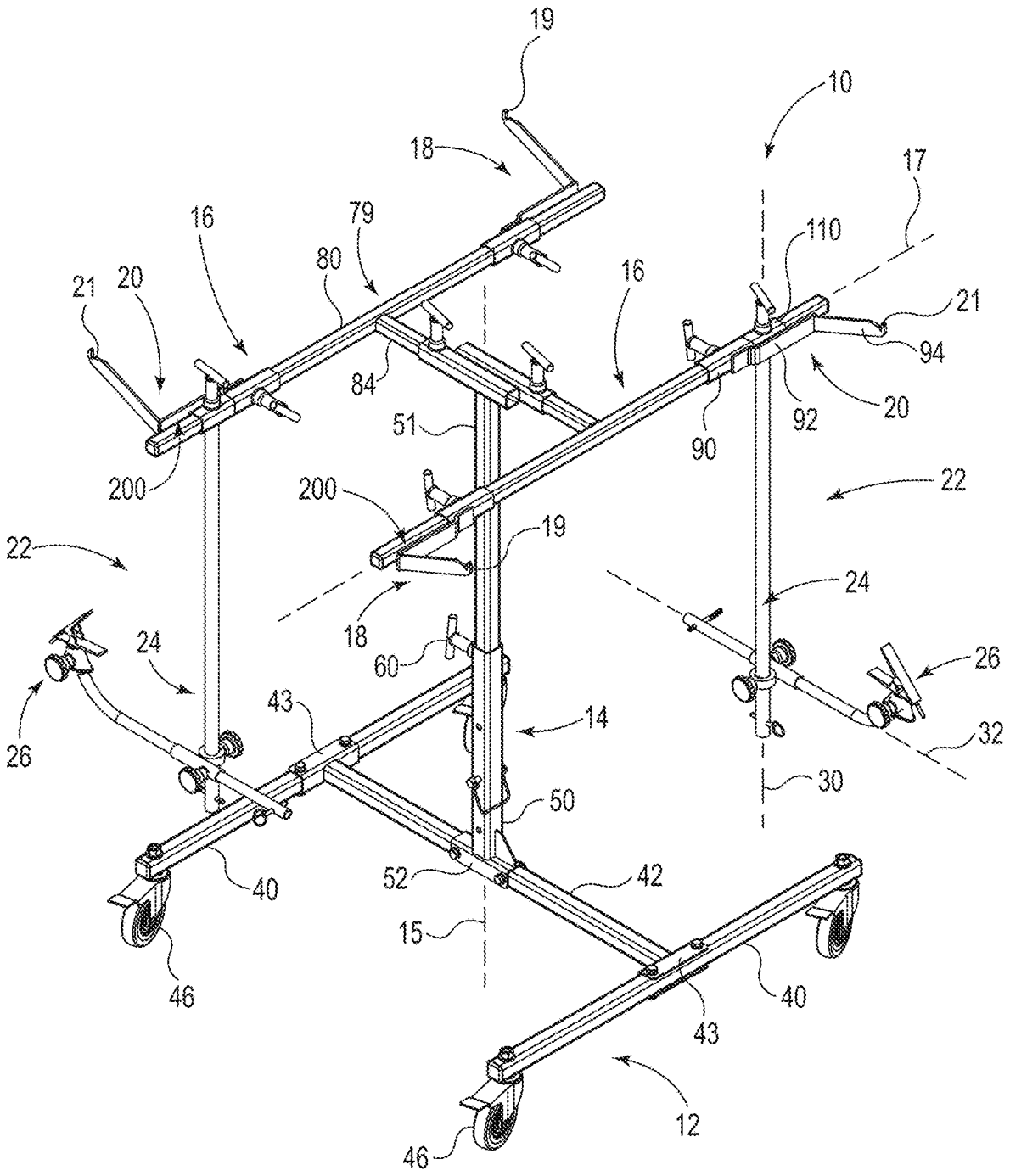
FIG. 1 is a perspective view of an exemplary embodiment of a stand for one or more objects, e.g., vehicle parts.
Figure 2:
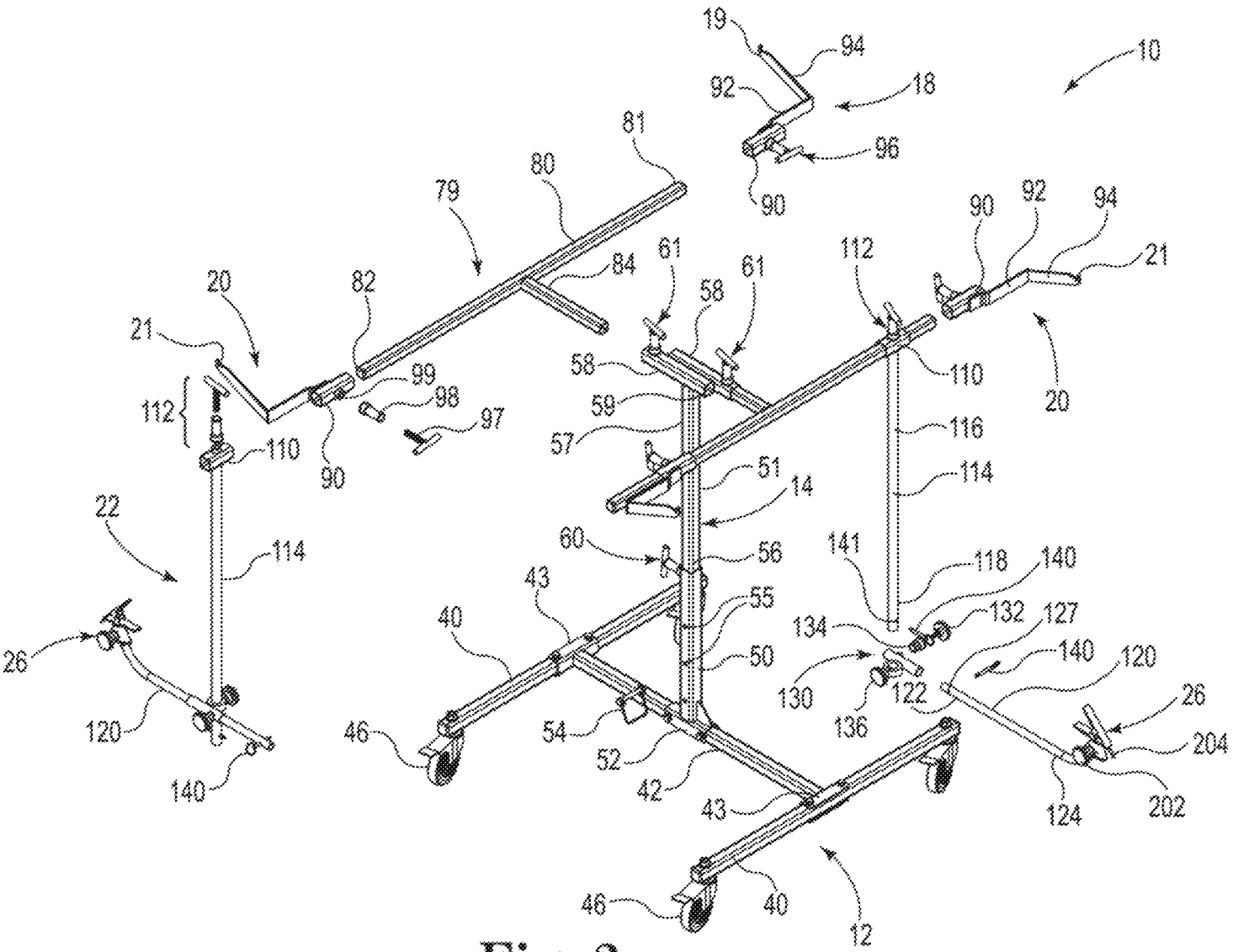
FIG. 2 is a partial exploded perspective view of the stand of FIG. 1.
Figure 4:
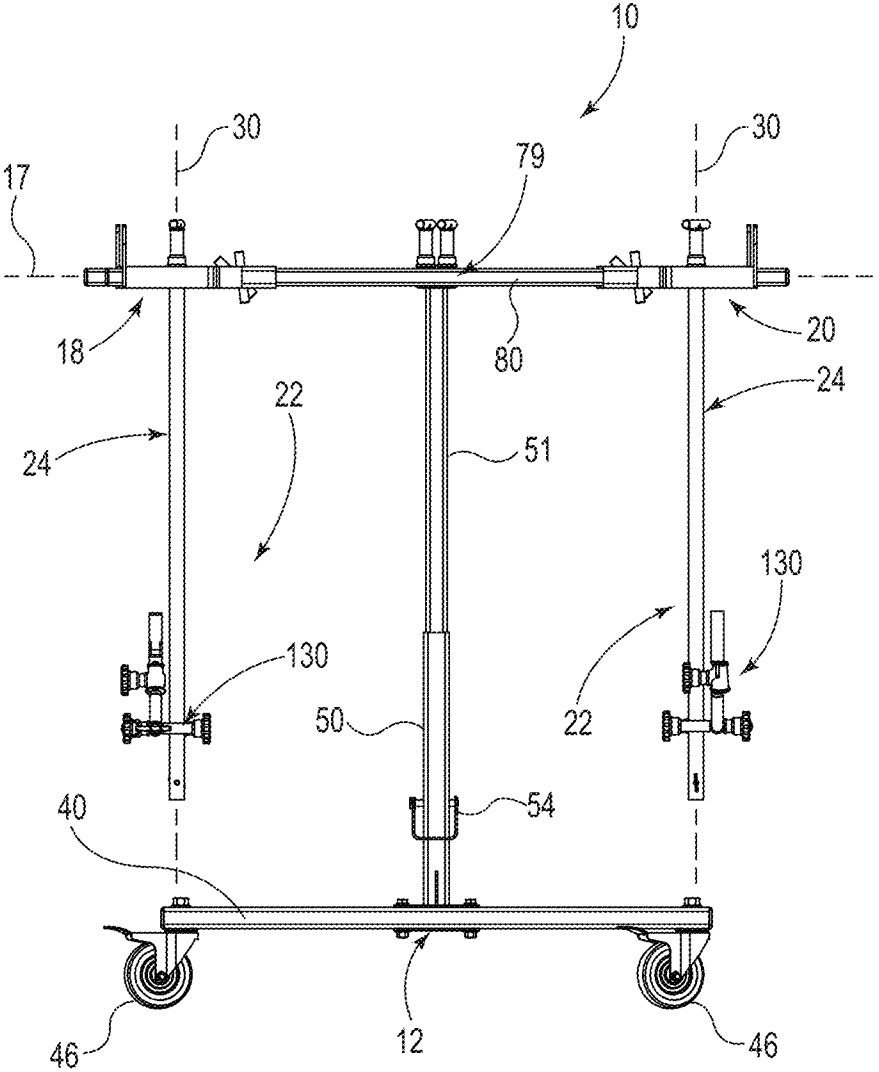
FIG. 4 is another side view of the stand of FIG. 1.
Figure 3:
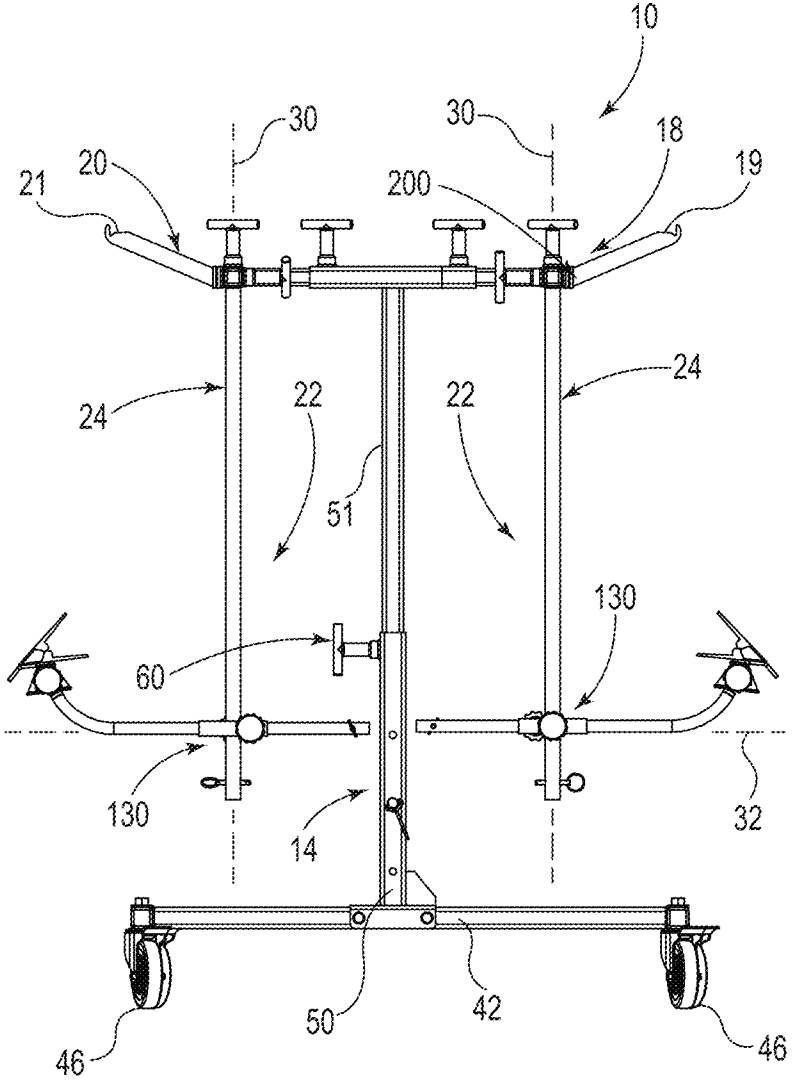
FIG. 3 is a side view of the stand of FIG. 1.

The figures are rendered primarily for clarity and, as a result, are not necessarily drawn to scale.

DETAILED DESCRIPTION OF EMBODIMENTS

In the following detailed description of illustrative embodiments, reference is made to the accompanying figures of the drawing which form a part hereof, and in which are shown, by way of illustration, specific embodiments which may be practiced. It is to be understood that other embodiments may be utilized and structural changes may be made without departing from the scope of the disclosure.

Exemplary embodiments of a stand 10 are shown and shall be described with reference to FIGS. 1-7. The use of such exemplary embodiments of the stand 10 is shown and shall be described with reference to FIGS. 8-11.

The exemplary stand 10 shown in FIGS. 1-4 includes base support 12 configured to engage a ground surface and an upright support 14 extending upward from the base support 12. The base support 12 is configured to hold the upright support 14 in an upright position along axis 15 (e.g., in a vertical position). The base support 12 may be formed of any structure suitable to support the upright support 14 and various features coupled thereto when in use (e.g., object coupling apparatus, support arms, drop support arm apparatus, vehicle doors, vehicle fenders, etc.).

In one or more embodiments, the base support 12 as shown in FIGS. 1-4 may include two base leg elements 40 separated by and coupled together by a base cross support element 42. For example, the ends of the base cross support element 42 may be coupled to the mid-region of each of the two base leg elements 40 by coupling apparatus 43. For example, such coupling apparatus 43 may include brackets, nuts and bolts, braces, or any other fixation apparatus (e.g., including welds) suitable to provide such coupling.

At least in one embodiment, the base leg elements 40 may be separated by a distance (e.g., using one or more cross elements such as base cross support element 42) suitable to maintain the stand 10 in an upright position during its use (e.g., when holding a vehicle object such as a door or fender, when holding two doors and/or fenders, etc.). Further, as shown in FIGS. 1-4, the base support 12 may include a plurality of wheels 46 (e.g., caster wheels that are lockable) distributed at one or more positions under structure forming the base support 12. For example, as shown in FIGS. 1-4, four wheels 46 are provided to permit the stand 10 to be moved easily and locked into position. The four wheels 46 are coupled at the ends of each of the base leg elements 40.

The upright support 14 extending upward from the base support 12 is configured to hold one or more object coupling apparatus 16 at an elevated position above the ground surface. The upright support 14 may be formed of any structure suitable to support the one or more object coupling apparatus 16 and the objects coupled thereto when in use (e.g., vehicle doors, vehicle fenders, etc.). Further, the upright support 14 may be configured as an extendable support such that the support can be lengthened and shortened (as desired) and a locked into one or more lengths along axis 15 (e.g., to raise or lower the object coupling apparatus 16 relative to the ground).

In one or more embodiments, the upright support 14 as shown in FIGS. 1-4 may include a base upright portion 50 coupled to base cross support element 42 in an upright position along axis 15 by coupling apparatus 52. For example, such coupling apparatus 52 may include brackets, nuts and bolts, braces, or any other fixation apparatus (e.g., including welds) suitable to provide such coupling. The base upright portion 50 may include an opening through at least a portion thereof along axis 15 that is sized to receive a first end portion 56 of an upright extension portion 51.

The upright extension portion 51 extends along axis 15 from the first end portion 56 inserted into an opening through the base upright portion 50 to a second end portion 57 which terminates at one or more connecting elements 58 (e.g., connecting sleeves or tubes for receiving or for connection with one or more structural elements, for example, mating or telescoping sleeves or tubes, of the one or more object coupling apparatus 16). At least in one embodiment, as shown in FIGS. 1-4, the one or more connecting elements 58 include connecting sleeves. Such connecting sleeves 58 define openings 59 extending through each sleeve 58 in a direction orthogonal to axis 15. Each of the connecting sleeves 58 is associated with a locking apparatus 61 for use in setting and locking into position structure (e.g., a part of the T shaped upper support element 79) of the object coupling apparatus 16 received within the openings 59 extending through each sleeve 58.

Any suitable locking apparatus 61 may be used to provide such functionality. As shown in FIGS. 1-4, such locking apparatus 61 (which may be used in one or more various locations of the stand to provide a locking functionality) is provided by a threaded nut (such as the one shown by reference numeral 99) affixed to the connecting sleeve 58 with its threaded opening aligned with an opening through the side of the connecting sleeve 58 and thru to the opening 59. A threaded tee handle (such as the one shown by reference numeral 97) may be inserted through a rubber sleeve (such as the one shown by reference numeral 98) and then threaded through the threaded nut into the opening 59 to engage any structure received therein and to lock such structure into a locked position. One will recognize that any suitable locking apparatus may be used (e.g., clamps, spring-loaded elements, locking keys, etc.) and that the specific locking structure described herein is not to be taken as limiting on the present disclosure.

At least in one embodiment as shown in FIGS. 1-4, to provide an extendable upright support 14 that may be locked at one or more lengths along axis 15, the base upright portion 50 and the upright extension portion 51 are configured in a telescoping manner (e.g., the first end portion 56 of the upright extension portion 51 is insertable into an opening of the base upright portion 50; however, the first end portion 56 could be configured to receive the upright extension portion 50). At least in one embodiment, the first end portion 56 of the upright extension portion 51 includes openings (not shown) that correspond to openings 55 in the base upright portion 50. A pin with a clip 54 may be inserted into such openings 55 and those of the first end portion 56 to lock the upright extension portion 51 at a particular position relative to the base upright portion 50. In at least in another embodiment, only openings 55 may be used. For example, the pin with clip 54 may be inserted through the openings 55 and the upright extension portion 51 when inserted into the opening of the base upright portion 50 may rest on the pin with clip 54. In either configuration, a locking apparatus 60 (e.g., similar to that shown and described with reference to locking apparatus 61) may be used to lock the upright extension portion 51 within the opening of the base upright portion 50. However, one skilled in the art will recognize that any structure suitable for providing extension of the upright support 14 (as well as locking the extended upright support 14 at a particular length) may be used and that the present disclosure is not limited to any particular type of extension technique.

The stand 10 may include one or more object coupling apparatus 16 coupled to the upright support 14. At least in one embodiment, each of the object coupling apparatus 16 is configured to be coupled to a different object received by the stand (e.g., a fender, a door, etc.). Each of the object coupling apparatus 16 may include an upper support element 79 configured to be coupled to the upright support 14 and configured to cooperate with one or more various arm type structures used to provide coupling points with an object received by the stand 10 (e.g., a fender, a door, etc.).

As shown in FIGS. 1-4, first and second object coupling apparatus 16 are coupled to the upright support 14 opposite one another. The first and second object coupling apparatus 16 elevated above the ground surface are substantially similar on opposite sides of the upright support 14. For simplicity, a single object coupling apparatus 16 shall be described. However, it may be possible for any number of object coupling apparatus 16 to be coupled to the upright support 14 and elevated above the ground surface (e.g., three object coupling apparatus 16 may be coupled to and spaced about the upright support 14).

At least in one embodiment, the object coupling apparatus 16 provides at least three coupling points with the object to hold the object in a stable position. Further, at least in one embodiment, the object coupling apparatus 16 provides at least three coupling points with the object, wherein at least one coupling point is at a lower elevation (e.g., closer to the ground surface) than the other coupling points. Further, at least in one embodiment, the object coupling apparatus 16 provides at least three coupling points with the object, wherein at least one coupling point is at a lower elevation (e.g., closer to the ground surface) than the other coupling points which are at substantially the same elevation.

In one or more embodiments, the object coupling apparatus 16 may include one or more different types of coupling elements usable for coupling to the object (e.g., at the coupling points or portions of the object). For example, and clearly not limited to the following, such coupling elements may include hooks, clamps (e.g., swivel clamps as described herein), pins, engagement surfaces or indents, integral with the arm or attached coupling elements, etc. Such coupling elements, as described herein, may terminate or be formed at the end of one or more structural elements (e.g., arms, bent members, angled arm elements, etc.); wherein such structural elements are either directly or indirectly coupled to the upper support element 79.

As shown in FIGS. 1-4, the upper support element 79 of object coupling apparatus 16 is coupled to the upright support 14 and may include an elongate support element 80 elevated above the ground surface. The elongate support element 80 extends along an axis 17 between a first end 81 and a second end 82. The elongate support element 80 may be coupled to the upright support 14 and elevated above the ground by any suitable structural elements.

As shown in FIGS. 1-4, the upper support element 79 includes a connection element 84 extending orthogonal to the elongate support element 80 at its midpoint. The connection element 84 is configured to slide into the opening 59 of the connecting element 58 of the upright support 14. One skilled in the art will recognize that any number of elements may be used to suspend the elongate support element 80 above the ground surface. However, use of a single connection element 84 at the midpoint thereof allows various arm type structures to be moved more readily and effectively along the elongate support element 80 and along axis 17. Extension of the upright support 14 will raise the elongate support element 80 further from the ground surface and decreasing the length of the upright support 14 will lower the elongate support element 80 towards the ground surface.

As shown in FIGS. 1-4, various arm type structures of the object coupling apparatus 16 may be movable along the elongate support element 80. For example, at least in one embodiment, first and second support arms 18, 20 are movable along the elongate support element 80 elevated above the ground surface. Generally, the first and second support arms 18, 20 (e.g., left and right support arms) are mirror images of each other. Such first and second support arms 18, 20 may be positioned onto either the first end 81 or the second end 82 of the elongate support element 80 and moved therealong. For example, at least in one embodiment, such first and second support arms 18, 20 may be moved along the elongate support element 80 until structure thereof contacts connection element 84 extending orthogonal from the elongate support element 80.

In one or more embodiments, the first support arm 18 includes at least an arm element terminating a distance from the elongate support element 80 at a coupling element 19 usable to couple the first support arm 18 to a first portion of an object to be received by the stand. Likewise, in at least in one embodiment, the second support arm 20 includes at least an arm element terminating a distance from the elongate support element 80 at a coupling element 21 usable to couple the second support arm 20 to a second portion of the object to be received by the stand.

For example, as shown in FIGS. 1-4 and the enlarged view of FIG. 5, the first support arm 18 may include an attachment element 90 movable along the axis 17 of the elongate support element 80. At least in one embodiment, the attachment element 90 defines a channel 91 therethrough sized such that the attachment element 90 may slide along the elongate support element 80. One will recognize that any attachment element suitable to provide a user the ability to move the first support arm 18 along the elongate support element 80 may be used. For example, a C-type structure where the channel 91 is not entirely enclosed may be used, as well as any other suitable sliding or movable element.

The first support arm further includes a first arm element 92 having a proximal end 102 coupled to the attachment element 90 (e.g., the proximal end 102 being welded or otherwise attached to a surface of the attachment element 90). The first arm element 92 is offset from the elongate support element 80 such that a gap 200 is defined therebetween (see FIG. 1). The offset distance 108 used to create the gap 200 is shown in FIG. 5D. As will be recognized from the description herein, the gap 200 is sized such that one or more other arm type structures may be movable along the elongate support element 80 and within the gap 200 (e.g., the drop support arm apparatus 22 is shown to have been moved within the gap 200 created between second support arm 20 and elongate support element 80 in FIG. 1).

Further, as shown in FIGS. 1-4 and the enlarged view of FIG. 5, a second arm element 94 of the first support arm 18 is coupled to a distal portion 104 of the first arm element 92. The second arm element 94 may, for example, terminate a distance from the elongate support element 80 at the coupling element 19 usable to couple the first support arm to the object being received by the stand. The coupling element 19 may be a hook element open in the upward direction for engaging a portion of the object (e.g., such as an opening in a door or fender).

Still further, a threaded nut 99 is fixed to a surface of the attachment element 90 at a location corresponding to a through opening in the surface to channel 91. In such a manner, a locking apparatus such as described herein with respect to locking apparatus 61 may be used to lock the first support arm 18 at a position on the elongate support element 80. For example, as shown in the exploded view of FIG. 2, a threaded nut 99 on an attachment element 90 of a second support arm 20, along with a tee handle 97 and rubber sleeve 98, provide the locking apparatus for locking the second support arm 20 at a position on the elongate support element 80.

Figure 5A:
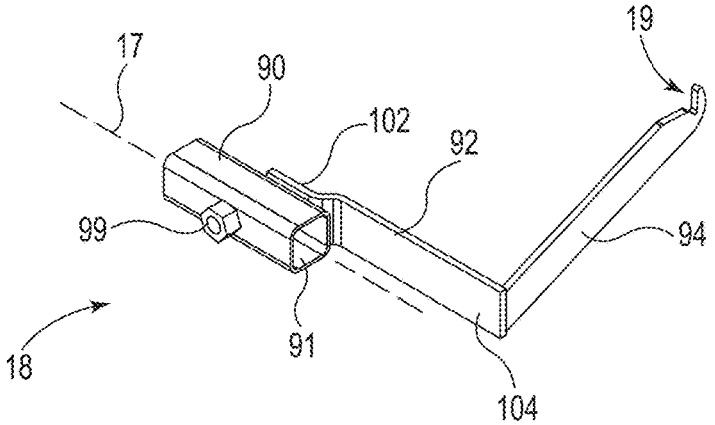
FIGS. 5A-5D are a more detailed perspective view, side view, additional side view, and top plan view, respectively, of the movable (e.g., slidable) support arm of the stand of FIG. 1.
Figure 5B:
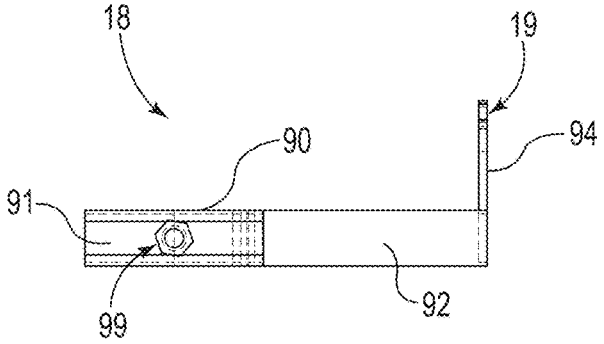
Figure 5C:
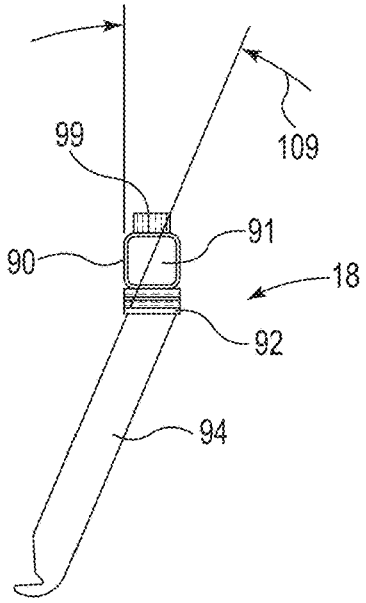
Figure 5D:
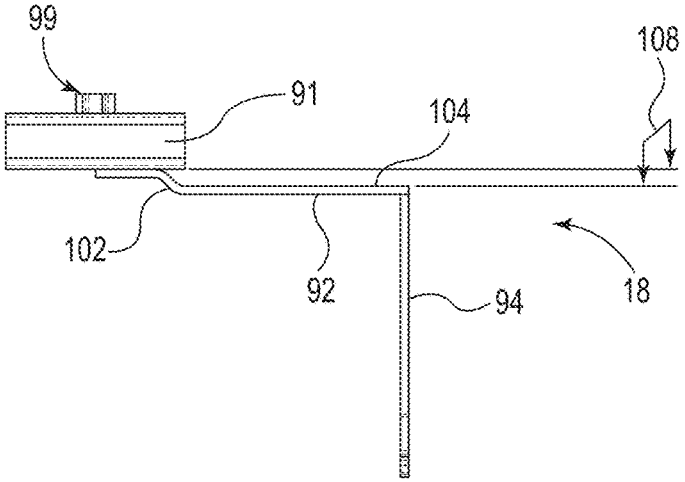

Yet further, as shown in FIGS. 1-5 and particularly FIG. 5C, the second arm element 94 coupled to a distal portion 104 of the first arm element 92 extends orthogonally from the first arm element 92 (and thus, orthogonal to axis 17) and at an angle 109 upward relative to the axis 17 along which the elongate support element 80 extends. Angle 109 may be any suitable angle, and at least, in one embodiment, for example, angle 109 may be in the range of 15 degrees to 35 degrees.

For simplicity, the description above for a support arm is provided primarily with reference to first support arm 18. It will be recognized that the same or similar structure described with respect to first support arm 18 is applicable to the second support arm 20 (except it is a mirror image thereof) and as such further detailed description of second support arm 20 will not be provided.

Further, at least in one embodiment, and as illustrated in FIGS. 1-4, the coupling elements 19, 21 of the first and second support arms 18, 20 are located at an elevation above the elongate support element 80. As described further herein, other arm type structures of the object coupling apparatus 16 which are movable along the elongate support element 80 provide coupling elements at an elevation below the elongate support element 80.

For example, at least in one embodiment, a drop support arm apparatus 22 is movable along the elongate support element 80 to provide a coupling element at an elevation below the elongate support element 80. For example, at least in one embodiment, the drop support arm apparatus 22 includes a drop arm portion extending in a direction downward toward the ground surface from the elevated elongate support element 80 and a distal coupling element 26 (e.g., a clamp and/or a pin element) movable to various positions at one or more elevations above the ground surface that are less than an elevation of the coupling elements 19, 21 of either the first and second support arms 18, 20. The distal coupling element 26 is usable to couple the drop support arm apparatus 22 to another coupling point or portion of the object being received by the stand.

The drop arm portion of the drop support arm apparatus 22 may include any type of structure that provides for a distal coupling element 26 that is movable to various positions below the elongate support element 80 (e.g., far enough below the elongate support element 80 to provide a stability benefit when used with other arm type structures of the object coupling apparatus 16). The drop arm portion may be provided by a plurality of elements connected together either in a fixed manner or in a movable manner relative to each other or the drop arm portion may be provided by a single element providing a distal coupling element movable to various positions.

At least in one or more embodiments, and as illustrated in FIGS. 1-4, the drop support arm apparatus 22 may include a drop arm portion (see reference no. 24) that extends downward toward the ground surface at least partially along a drop axis 30 (e.g., a drop axis 30 that is substantially vertical to the ground surface). As shown therein, the distal coupling element 26 may be movable to various positions using the drop arm portion 24. For example, the distal coupling element 26 may be movable vertically to one or more elevations above the ground surface (e.g., along drop axis 30), the distal coupling element 26 being movable horizontally along an axis (e.g., axis 32) orthogonal to the substantially vertical drop axis (e.g., drop axis 30), the distal coupling element 26 may be rotatable to one or more positions about the axis (e.g., axis 32) orthogonal to the drop axis (e.g., drop axis 30), and the distal coupling element 26 may be rotatable to one or more positions about the drop axis (e.g., drop axis 30). For example, a user may move the distal coupling element 26 to one or more positions using any one or more of such described user available motions.

At least in one or more embodiments, and as illustrated in FIGS. 1-4, the drop support arm apparatus 22 may include an attachment portion 110 movable along the elongate support element 80. Further, for example, the attachment portion 110 may include a threaded nut fixed thereto and a locking apparatus 112 substantially similar to the locking apparatus described with reference to locking apparatus 61 to lock the drop support arm apparatus 22 at a position on the elongate support element 80.

The drop support arm apparatus 20 may further include a drop arm portion 114 extending along drop axis 30 in a direction downward toward the ground surface from the elevated elongate support element 80. The drop arm portion 114 may extend along drop axis 30 from a proximal end portion 116 that is coupled to attachment portion 110 (e.g., welded or otherwise fixed thereto) to a distal end portion 118.

In addition, to provide for various positioning of coupling element 26, the drop support arm apparatus 20 further includes a coupling arm 120 (e.g., a bent coupling arm having a bend or one or more curves at the distal end portion 124 thereof) which may be coupled to the drop arm portion 114 (e.g., at the distal end portion 118) by a connection sleeve 130. The coupling arm 120 is movably coupled by the connection sleeve 130 to the drop arm portion 114 such that the coupling arm 120 (e.g., and the distal coupling element 26 that terminates an end of the coupling arm 120 and which follows the coupling arm movement) is movable along the drop axis 30, rotatable about the drop axis 30, and movable along and rotatable about the axis 32 which is orthogonal to the drop axis 30.

Figure 7:
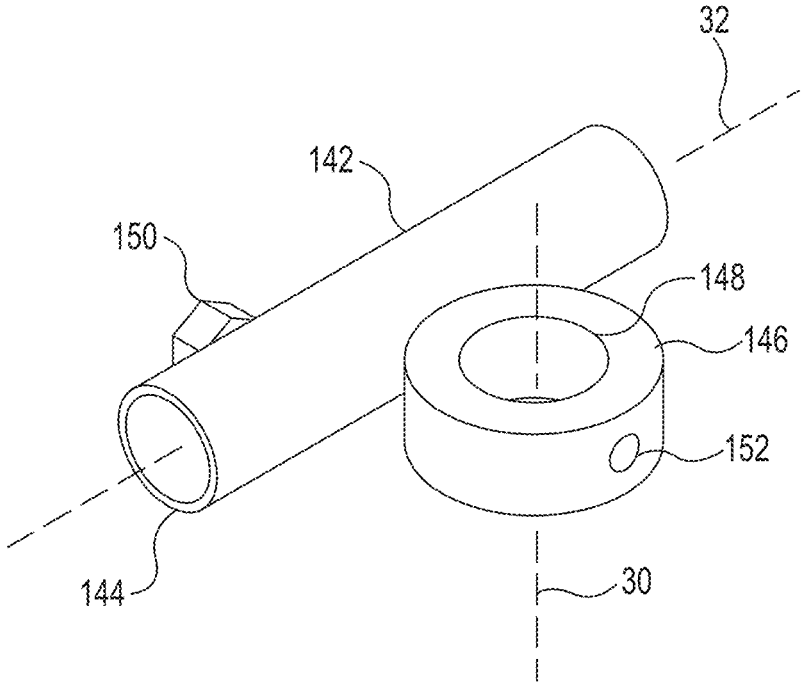
FIG. 7 is a more detailed perspective view of a connection sleeve of a drop support arm apparatus of the stand of FIG. 1.

At least in one or more embodiments, and as illustrated in FIGS. 1-4 and the enlarged view of FIG. 7, the connection sleeve 130 includes a first sleeve portion 142 defining an opening 144 therethrough along axis 32. A second sleeve portion 146 coupled to the first sleeve portion 142 (e.g., welded or otherwise fixed thereto) defines an opening 148 therethrough along drop axis 30. The opening 148 extends along drop axis 30 which is orthogonal to the axis 32 along which opening 144 is defined. In other words, the cross-sections of opening 148 and 144 are orthogonal to one another; they lie in planes orthogonal to one another).

The distal end portion 118 of the drop arm portion 114 is insertable into defined opening 148 and the connection sleeve 130 is movable along and rotatable about the drop arm portion 114 extending along drop axis 30. Second sleeve portion 146 further includes an opening 152 for receiving a locking apparatus 136 for use in locking the connection sleeve 130 at a position along the drop arm portion 114. A quick release pin 140 is used in an opening 141 through the distal end portion 118 of the drop arm portion 114 to keep the connection sleeve 130 from falling off the distal end portion 118.

Further, a proximal end portion 122 of the coupling arm 120 is insertable into defined opening 144 of the connection sleeve 130 and the coupling arm 120 is movable within the opening 144 of the connection sleeve 130 along axis 32 and rotatable within the opening 144 about axis 32. First sleeve portion 142 further includes a threaded nut aligned with an opening through first sleeve portion 142 into opening 144 for receiving a locking apparatus 132 for use in locking the coupling arm 120 at a position within the opening 144 of the first sleeve portion 142. A quick release pin 140 is used in an opening 127 through the proximal end portion 122 of the coupling arm 120 to keep coupling arm 120 from falling out of the connection sleeve 130. The distal coupling element 26 is located at the distal end portion 124 of coupling arm 120.

In one or more embodiments, any coupling element (e.g., a coupling element directly attached to the object being received by the stand 10) may take the form of a swivel clamp movable in multiple positions with use of a ball and socket. For example, as shown in FIGS. 1-4, the coupling element 26 takes the form of such a swivel clamp. For example, the swivel clamp 26 may be a clamp such as described in U.S. Pat. No. 7,445,184 to Johnson, entitled "Mobile Paint Rack." For example, the distal end portion 124 of the coupling arm 120 may have mounted thereto a swivel ball. The swivel ball may be received by a socket mounted to the swivel clamp 26 in such a manner to allow the swivel clamp 26 to be positioned in a variety of positions. A locking apparatus 202 may be used to lock the swivel clamp 26 at a particular position.

In one or more embodiments, the swivel clamp 26 (e.g., a clamp having two clamping members between which a structural element of an object to be received on the stand 10 may be clamped) may include a pin 204 fixed to one or both of the clamping members thereof. At least in one embodiment, the pin 204 is fixed to one of the clamping members and extends in a forward direction therefrom (e.g., in a direction opposite from the user graspable portion of the clamp). For example, the pin 204 may be sized for insertion into a hole of an object to be received on the stand 10.

Using the drop support arm apparatus 22 as described herein, a user may perform one or more of the following: move the drop support arm apparatus 22 along the elongate support element 80 (e.g., along axis 17) and lock it to a position thereon using locking apparatus 112; move the coupling arm 120 along with the coupling element 26 vertically by moving the coupling arm 120 along with connection sleeve 130 along drop arm portion 114 (e.g., along drop axis 30) and also rotate the coupling arm 120 along with the connection sleeve 130 about the drop arm portion 114 (e.g., about drop axis 30) and lock it to a position on the drop arm portion 114 using locking apparatus 136; and move the coupling element 26 horizontally by moving the coupling arm 120 within and through the connection sleeve 130 (e.g., along axis 32) and also rotate the coupling element 26 by rotating the coupling arm 120 within the connection sleeve 130 (e.g., about axis 32) and lock it to a position within the connection sleeve 130 using locking mechanism 132. Still further, at least in one embodiment, with the coupling element 26 being a swivel clamp, a user may also move the swivel clamp into one of the many positions available in view of its swivel nature and lock the swivel clamp at such a position using locking mechanism 202.

One skilled in the art will recognize that any number of arm type structures may be used as part of the object coupling apparatus 16 for coupling an object to be received by the stand 10. For example, the first and second support arms may be used with one or more drop support arm apparatus, multiple drop support arm apparatus may be used with a single support arm, or any combination of drop support arm apparatus and support arms may be used.

As shown in FIGS. 1-4 and FIGS. 6A-6B, the various arm type support structures, such as the support arms 18, 20 and drop support arm apparatus 22, may be movable along the elongate support element 80. Such support arms 18, 20 and drop support arm apparatus 22 may also be removable from the elongate support element 80 at either the first or second ends 81, 82 thereof. For example, a user may slide support arm 18 or any of the other arm type support structures to an end of the elongate support element 80 and remove it therefrom. In such a manner, the position of each of the various arm type support structures may be repositioned along the elongate support element 80. For example, as shown in FIG. 1, the attachment element 90 of the support arm 20 is located closer to the midpoint of the elongate support element 80 than the attachment element 110 of the drop support arm apparatus 22, whereas in the exploded view of FIG. 2, the attachment element 110 of the drop support arm apparatus 22 is shown as being received on the elongate support element 80 with the attachment element 90 of the support arm 20 not yet being received thereon to show that the location of such various arm type support structures may be switched around into any number of different configurations.

Still further with respect to FIGS. 1-4 and FIGS. 6A-6B, the location of the mirror image support arms 18, 20 may be switched to provide an extended distance range at which the coupling elements 19, 21 (e.g., hooks) may be located such that they can be used with relatively small objects and substantially larger objects. For example, as shown in FIGS. 1-4, the support arms 18, 20 are received on the elongate support element 80 such that the attachment element 90 is located closer to the midpoint of the elongate support element 80 than the first and second arm elements 92, 94. In such a configuration, each of the first and second support arms 18, 20 are positionable on the elongate support element 80 such that at least portions of the first arm element 92 and the second arm element 94 may extend beyond at least one of the first and second ends 81, 82 of the elongate support element 80. In this configuration a substantially large distance may be created between the coupling elements 19 and 21. For example, the largest distance may be created when the attachment elements 90 of each of the support arms 18, 20, are moved all the way to the first and second ends 81, 82, respectively, of the elongate support element 80.

Figure 6A:
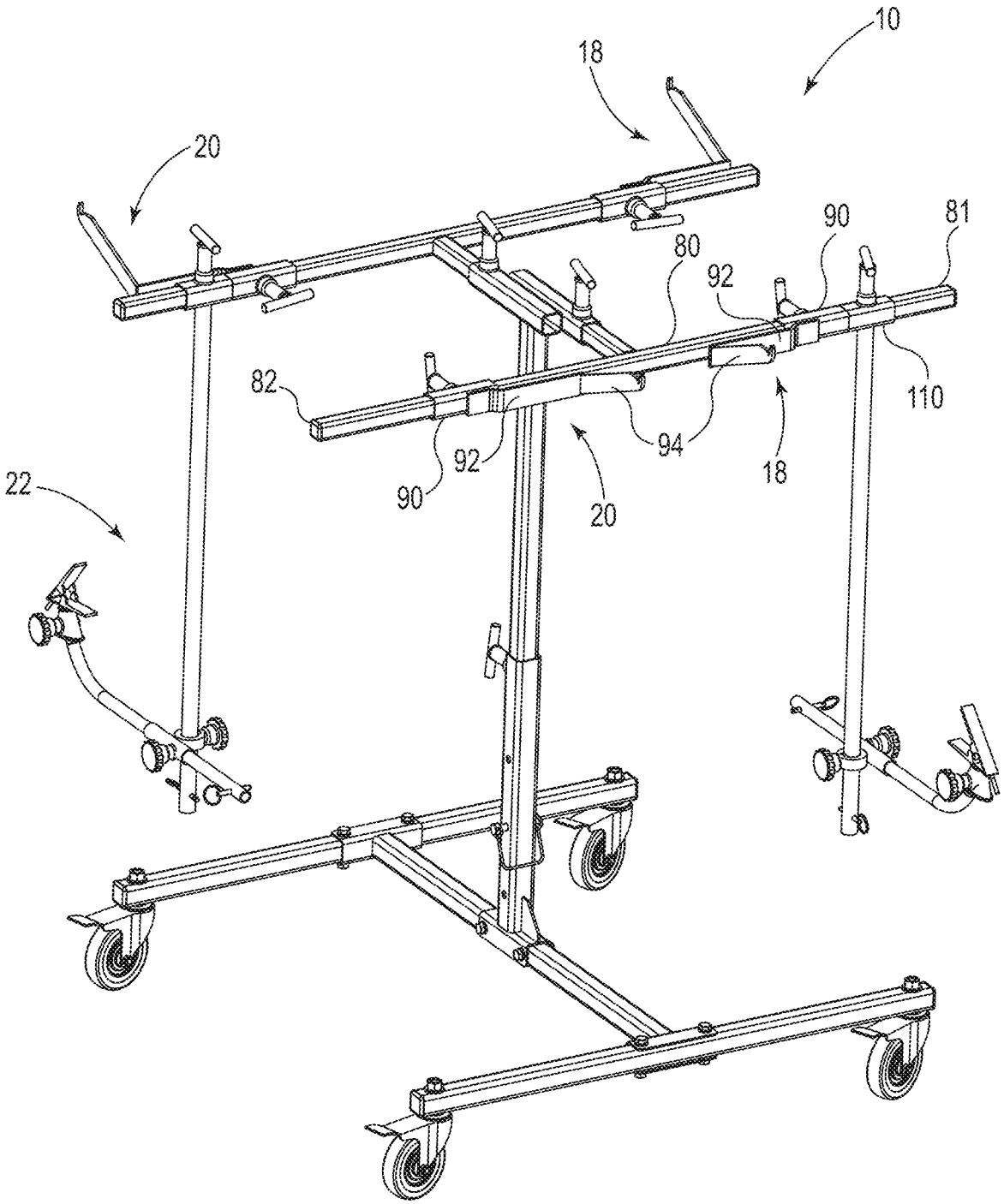
FIG. 6A is another perspective view of the stand of FIG. 1, wherein a couple of movable support arms have been removed and recoupled to the elongate support element of the stand to show an extended range of distances achievable between the movable arms.
Figure 6B:
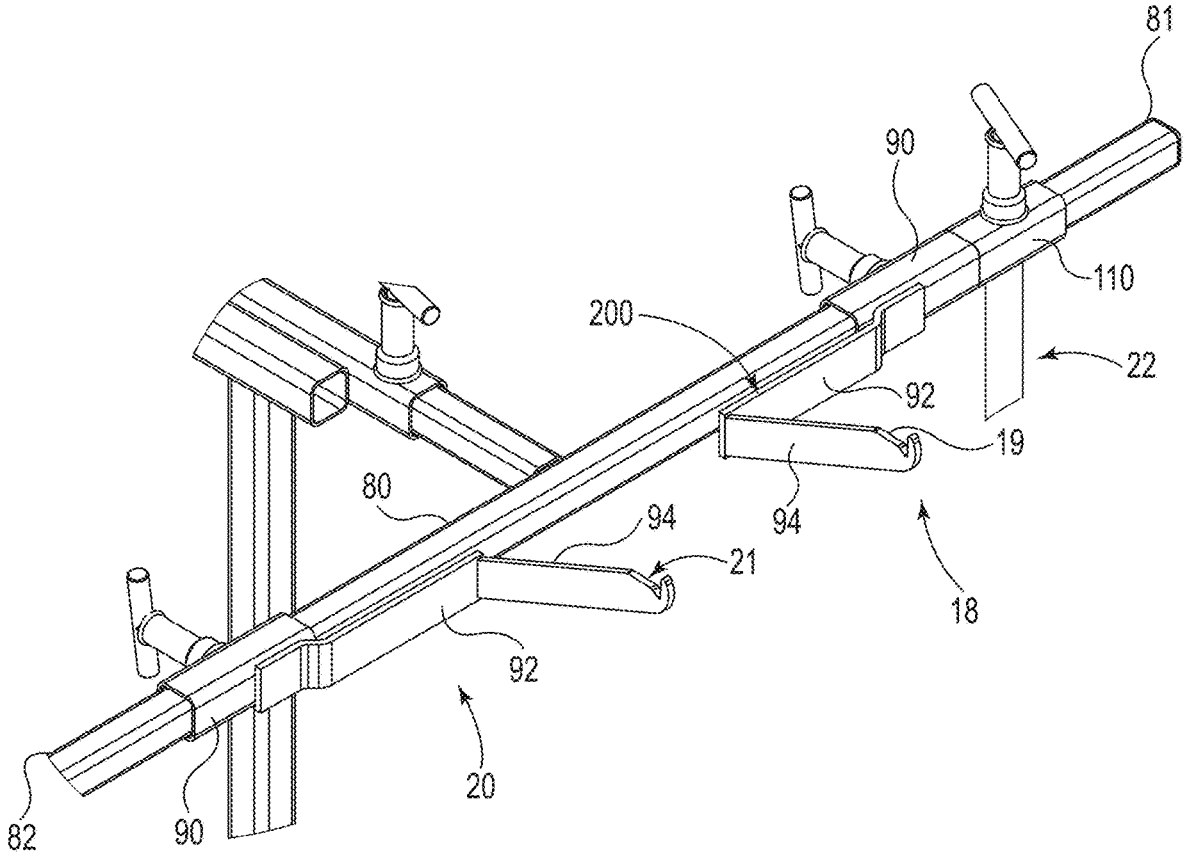
FIG. 6B is an enlarged view of a portion of FIG. 6A.

Further, for example, as shown in FIGS. 6A-6B, to create a much smaller distance between the coupling elements 19 and 21, the support arms 18, 20 are received on the elongate support element 80 such that the attachment element 90 is located closer to the end of the elongate support element 80 than the first and second arm elements 92, 94. In other words, each of the first and second support arms 18, 20 (as shown in FIG. 1) are removed from the ends of the elongate support element 80 and repositioned on the opposite end (e.g., they are switched relative to one another). In such a configuration, each of the first and second support arms 18, 20 may be positionable on the elongate support element 80 such that no portions of the first arm element 92 and the second arm element 94 extend beyond the first or second ends 81, 82 of the elongate support element 80. In this configuration a substantially small distance may be created between the coupling elements 19 and 21. For example, the smallest distance is created when the second arm elements 94 of each of the support arms 18, 20 actually touch (e.g., in the mid-region of the elongate support element 80).

The illustrations shown in FIGS. 8-11 are provided to show the use of the exemplary embodiments of the stand 10 described herein. For example, as shown in FIG. 8A, a fender 300 is coupled to the object coupling apparatus 16 of the stand 10. For example, hooks or coupling elements 19, 21 of support arms 18, 20 are hooked into bolt holes of the fender 300 as shown in FIG. 8C as well as the enlarged view of FIG. 11. The fender structure may also be received on such hooks at coupling points at an upper portion of the fender 300. The swivel clamp 26 of the drop support arm apparatus 22 may be clamped at a lower portion of the fender 300 and shown in FIG. 8D. Still further, at least in one embodiment, the pin 204 of swivel clamp 26 may be inserted through a bolt hole in the fender 300 at a lower portion thereof as shown in FIG. 8E as well as FIG. 9. It is noted that the drop support arm apparatus 22 is located closer to the end of the elongate support element 80 than the support arm 20 which is located closer to the mid-region of the elongate support element 80.

Figure 8C:
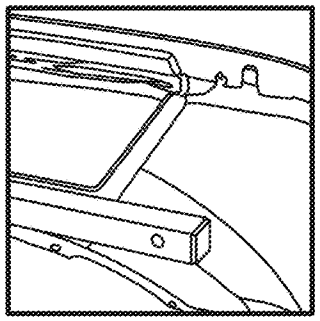
FIGS. 8A-8E are illustrations showing the use of one or more portions of the stand of FIG. 1 with vehicle parts (e.g., automobile doors and fenders).
Figure 8D:
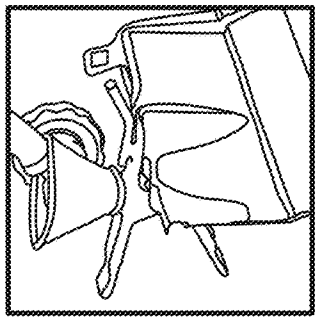
Figure 8E:
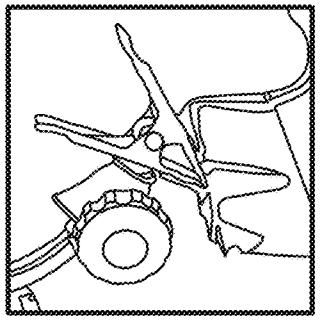
Figure 8B:
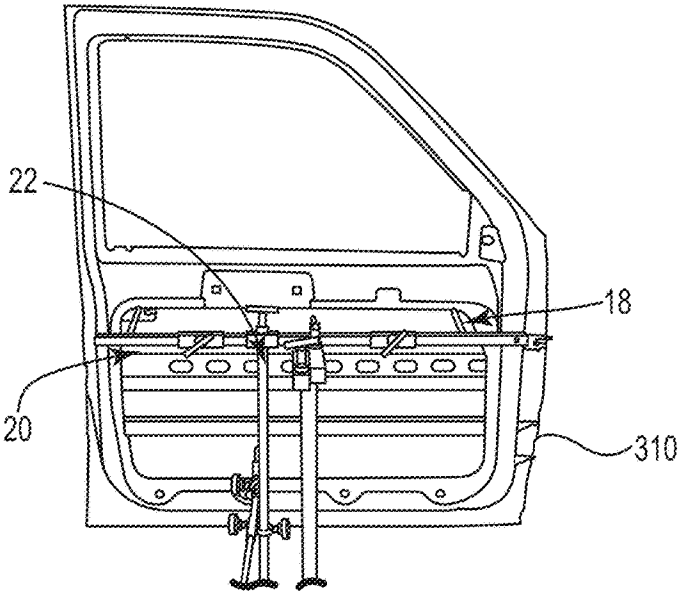
Figure 8A:
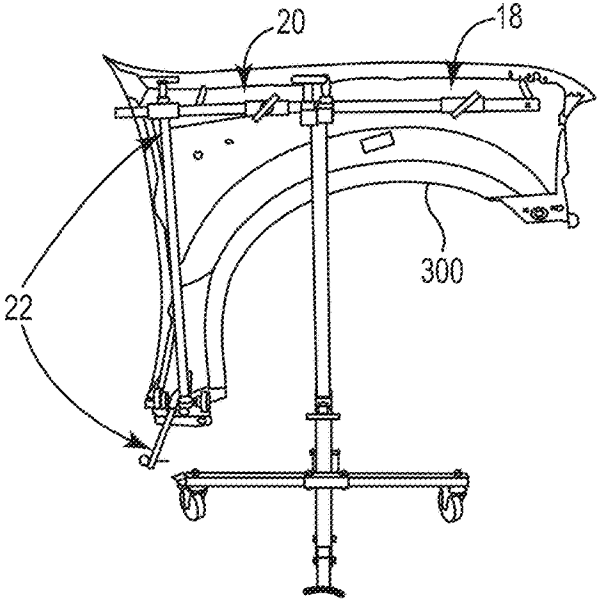
Figure 9:
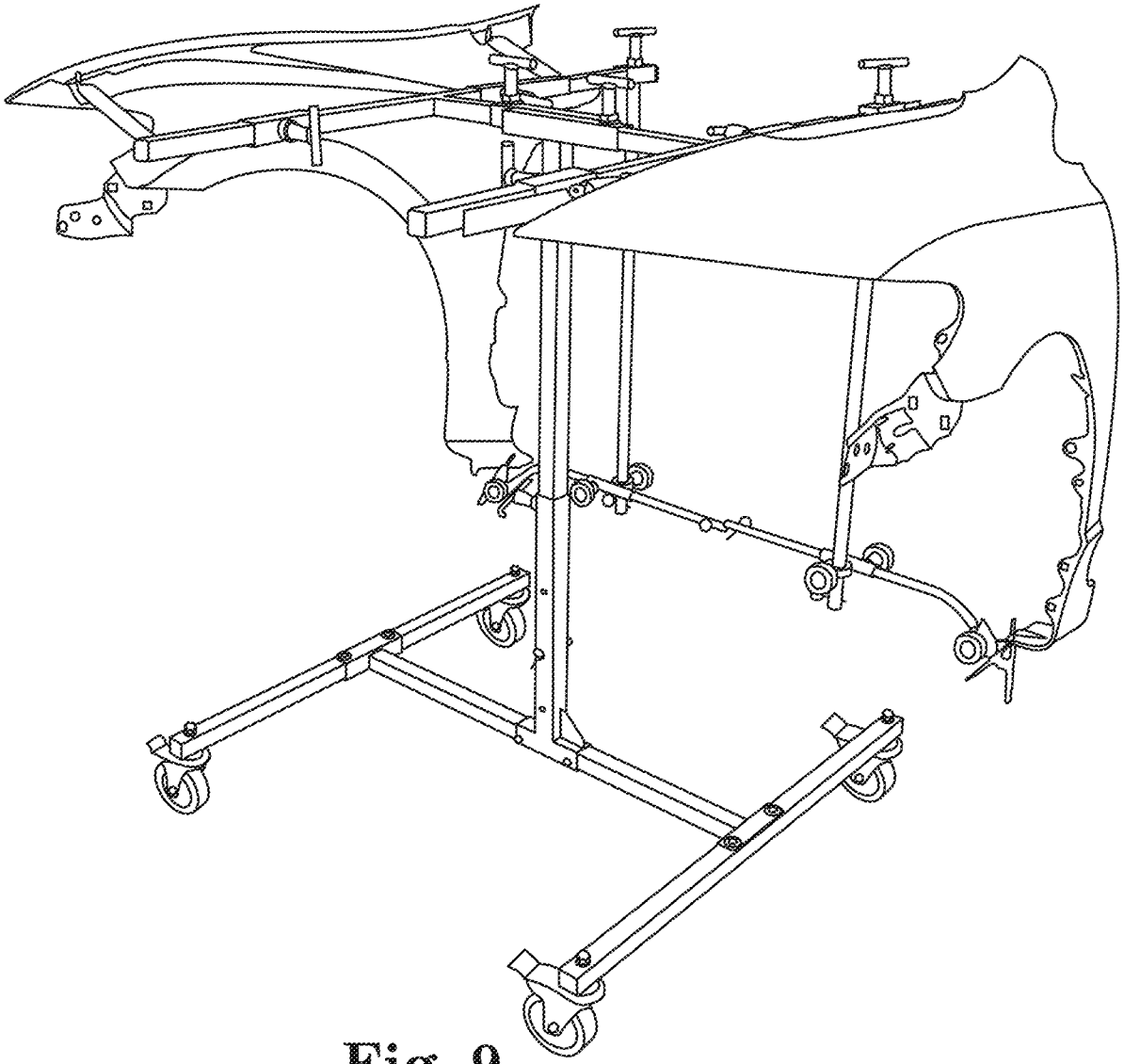
FIG. 9 is an illustration showing the use of the stand of FIG. 1 with vehicle fenders.
Figure 10:
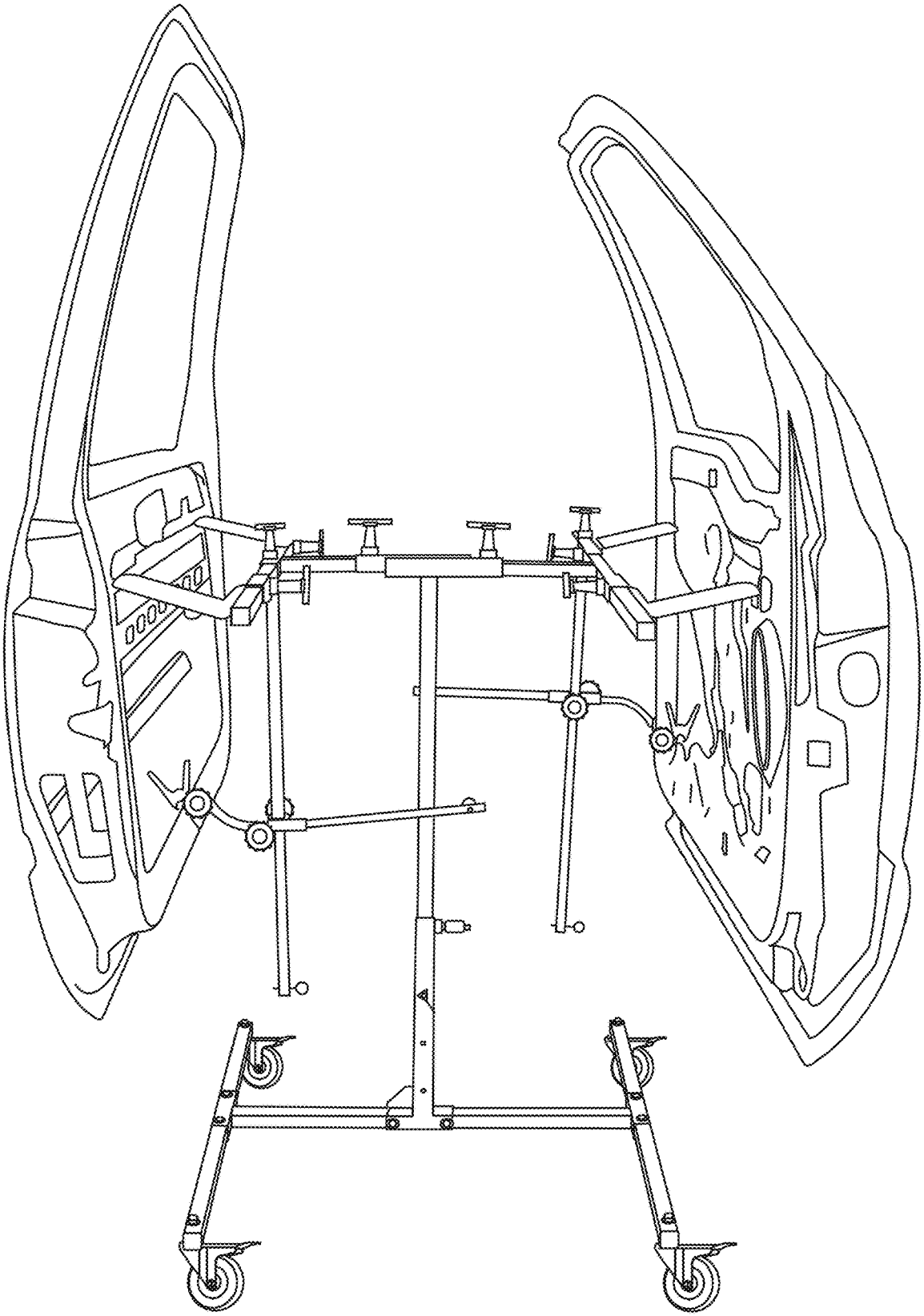
FIG. 10 is an illustration showing the use of the stand of FIG. 1 with vehicle doors.
Figure 11:
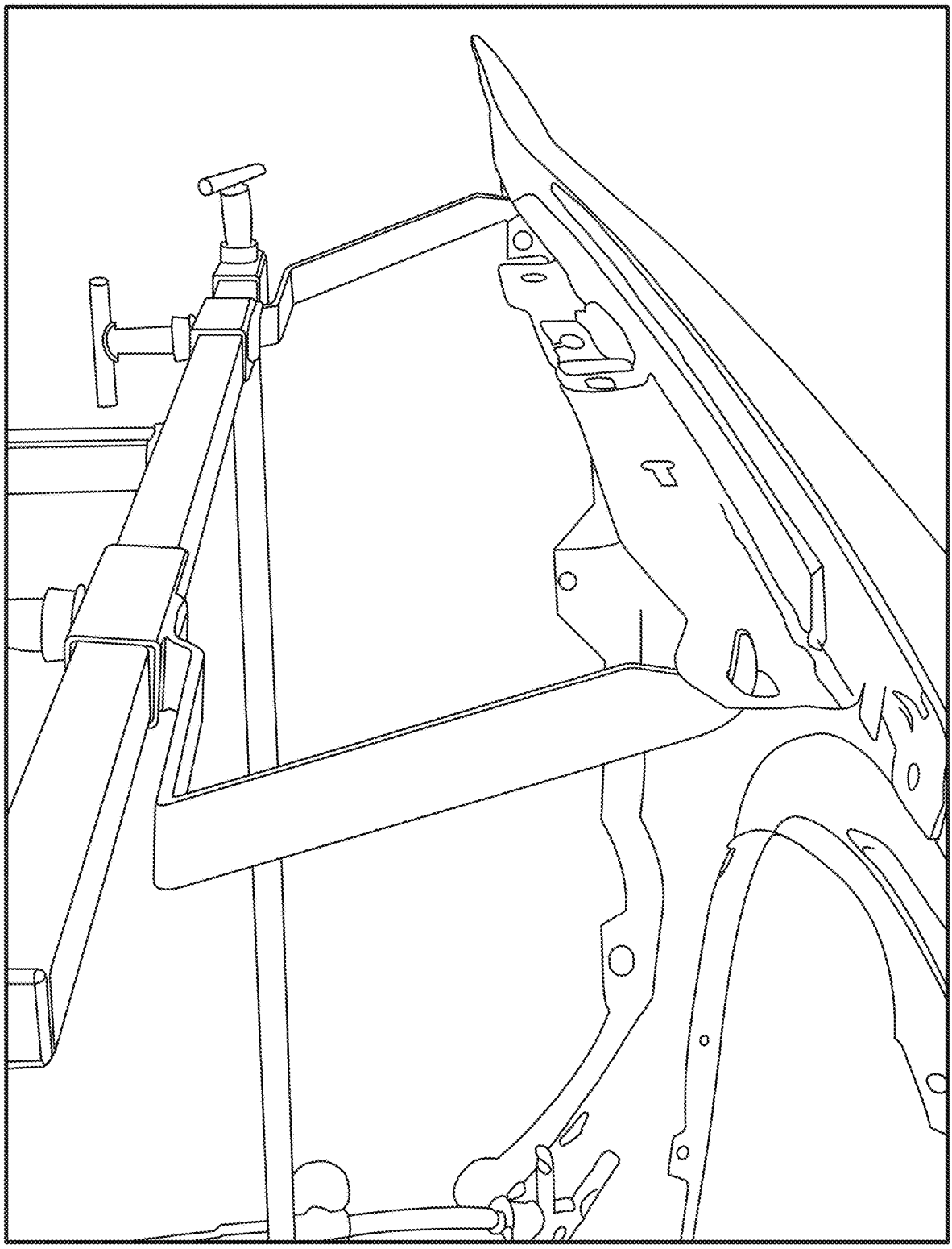
FIG. 11 is an illustration showing the use of movable support arms of the stand of FIG. 1 with a fender.

Further, for example, as shown in FIG. 8B, a door 310 is coupled to the object coupling apparatus 16 of the stand 10. For example, hooks or coupling elements 19, 21 of support arms 18, 20 are hooked into openings of the door 310 as shown, for example, in FIG. 10. The door structure may be received on such hooks at coupling points at an upper portion thereof. The swivel clamp 26 of the drop support arm apparatus 22 may be clamped at a lower portion of the door 310 as shown in FIG. 10. It is noted that, in FIG. 8B, the drop support arm apparatus 22 is located closer to the mid-region of the elongate support element 80 than the support arm 20 which is located closer to the end of the elongate support element 80.

All patents and references cited herein are incorporated in their entirety as if each were incorporated separately. This disclosure has been provided with reference to illustrative embodiments and is not meant to be construed in a limiting sense. As described previously, one skilled in the art will recognize that various other illustrative adapter assembly embodiments may be provided which utilize various combinations of the elements described herein. Various modifications of the illustrative embodiments, as well as additional embodiments of the disclosure and combinations of various elements herein, will be apparent to persons skilled in the art upon reference to this description. It is therefore contemplated that the patented claims will cover any such modifications or embodiments that may fall within the scope of the present invention as defined by the accompanying claims.

The invention claimed is:

1. A stand for receiving one or more objects comprising:

a base support configured to engage a ground surface;

an upright support extending upward from the base support; and one or more object coupling apparatus, wherein each object coupling apparatus comprises:

an upper support element coupled to the upright support, wherein the upper support element comprises an elongate support element elevated above the ground surface;

first and second support arms movable along the elongate support element elevated above the ground surface, wherein the first support arm comprises at least one arm element terminating a distance from the elongate support element at a coupling element usable to couple the first support arm to a first portion of an object of the one or more objects and wherein the second support arm comprises at least one arm element terminating a distance from the elongate support element at a coupling element usable to couple the second support arm to a second portion of the object; and a drop support arm apparatus movable along the elongate support element, wherein the drop support arm apparatus comprises a drop arm portion extending in a direction downward toward the ground surface from the elevated elongate support element, wherein the drop support arm apparatus further comprises a coupling arm movably coupled to the drop arm portion and providing a distal coupling element movable to various positions at one or more elevations above the ground surface that are less than an elevation of the coupling element of either the first and second support arms, the distal coupling element being usable to couple the drop support arm apparatus to a third portion of the object, wherein the drop arm portion extends at least partially along a drop axis substantially vertical to the ground surface, and further wherein the distal coupling element is movable vertically relative to the drop arm portion to one or more elevations above the ground surface, the coupling arm is movable relative to the drop arm portion along an axis orthogonal to the drop axis, the coupling arm is rotatable relative to the drop arm portion to one or more positions about the axis orthogonal to the drop axis, and the distal coupling element is rotatable relative to the drop arm portion to one or more positions about the drop axis.

2. The stand of claim 1, wherein the drop support arm apparatus comprises an attachment portion movable along the elongate support element, a proximal end of the drop arm portion being coupled to the attachment portion and extending along the drop axis in a direction downward toward the ground surface from the elevated elongate support element, wherein the distal coupling element terminates an end of the coupling arm.

3. The stand of claim 1, wherein the distal coupling element comprises a swivel clamp movable in multiple positions with use of a ball and socket.

4. The stand of claim 1, wherein the one or more object coupling apparatus comprises first and second object coupling apparatus coupled to the upright support opposite one another, wherein the first and second object coupling apparatus are configured to be coupled to first and second objects, respectively.

5. The stand of claim 1, wherein each of the first and second support arms and the drop support arm apparatus movable along the elongate support element are removable from at least one of a first end and a second end of the elongate support element.

6. The stand of claim 1, wherein at least one of the first and second support arms comprises:

an attachment element movable along an axis of the elongate support element;

a first arm element of the at least one arm element comprising a proximal end coupled to the attachment element and extending along the direction of the axis of the elongate support element, wherein the first arm element is offset from the elongate support element such that a gap is defined therebetween, wherein the gap is sized such that the drop support arm apparatus is movable along the elongate support element within the gap; and a second arm element of the at least one arm element coupled to a distal portion of the first arm element and terminating a distance from the elongate support element at the coupling element usable to couple the at least one of the first and second support arms to the object.

7. The stand of claim 6, wherein the second arm element coupled to the distal portion of the first arm element extends orthogonally therefrom and at an angle upward relative to the axis of the elongate support element.

8. The stand of claim 6, wherein each of the first and second support arms movable along the elongate support element are removable from at least one of a first and a second end of the elongate support element, each of the first and second support arms being positionable on the elongate support element such that at least portions of the first arm element and second arm element extend beyond at least one of the first and second ends of the elongate support element and also being positionable on the elongate support element such that no portions of the first arm element and second arm element extend beyond the first or second ends of the elongate support element.

9. A stand for receiving one or more objects comprising:

a base support configured to engage a ground surface;

an upright support extending upward from the base support; and one or more object coupling apparatus, wherein each object coupling apparatus comprises:

an upper support element coupled to the upright support, wherein the upper support element comprises an elongate support element elevated above the ground surface;

one or more support arms movable along the elongate support element elevated above the ground surface, wherein each support arm comprises at least one coupling element usable to couple the support arm to a portion of an object of the one or more objects; and a drop support arm apparatus movable along the elongate support element, wherein the drop support arm apparatus comprises:

a drop arm portion extending at least partially along a drop axis substantially vertical to the ground surface, and a coupling arm movably coupled to the drop arm portion and providing a distal coupling element movable vertically relative to the drop arm portion to one or more elevations above the ground surface, wherein the coupling arm is movable relative to the drop arm portion along an axis orthogonal to the substantially vertical drop axis, the coupling arm is rotatable relative to the drop arm portion to one or more positions about the axis orthogonal to the drop axis, and the distal coupling element is rotatable relative to the drop arm portion to one or more positions about the drop axis, wherein the distal coupling element being usable to couple the drop support arm apparatus to another portion of the object.

10. The stand of claim 9, wherein the drop support arm apparatus comprises an attachment portion movable along the elongate support element, a proximal end of the drop arm portion being coupled to the attachment portion and extending along the drop axis in a direction downward toward the ground surface from the elevated elongate support element, wherein the distal coupling element terminates an end of the coupling arm.

11. The stand of claim 9, wherein the distal coupling element comprises a swivel clamp movable in multiple positions with use of a ball and socket.

12. The stand of claim 9, wherein the one or more object coupling apparatus comprises first and second object coupling apparatus coupled to the upright support opposite one another, wherein the first and second object coupling apparatus are configured to be coupled to first and second objects, respectively.

13. The stand of claim 9, wherein each of the one or more support arms and the drop support arm apparatus movable along the elongate support element are removable from at least one of a first end and a second end of the elongate support element.

14. The stand of claim 9, wherein at least one of the one or more support arms comprises:

an attachment element movable along an axis of the elongate support element;

a first arm element comprising a proximal end coupled to the attachment element and extending along the direction of the axis of the elongate support element, wherein the first arm element is offset from the elongate support element such that a gap is defined therebetween, wherein the gap is sized such that the drop support arm apparatus is movable along the elongate support element within the gap; and a second arm element coupled to a distal portion of the first arm element and terminating a distance from the elongate support element at the coupling element usable to couple the at least one of the one or more support arms to the object.

15. The stand of claim 14, wherein the second arm element coupled to a distal portion of the first arm element extends orthogonally therefrom and at an angle upward relative to the axis of the elongate support element.

16. A stand for receiving one or more vehicle parts comprising:

a base support configured to engage a ground surface;

an upright support extending upward from the base support; and one or more object coupling apparatus, wherein each object coupling apparatus comprises:

an upper support element coupled to the upright support, wherein the upper support element comprises an elongate support element elevated above the ground surface; and first and second support arms movable along the elongate support element elevated above the ground surface, wherein each of the first and second support arms comprises:

an attachment element movable along an axis of the elongate support element;

a first arm element comprising a proximal end coupled to the attachment element and extending away from the attachment element along the direction of the axis of the elongate support element to a distal portion of the first arm element, wherein the first arm element is offset from the elongate support element such that a gap is defined therebetween; and a second arm element coupled to the distal portion of the first arm element and terminating a distance from the elongate support element at a coupling element configured to be coupled to the one or more vehicle parts;

wherein each of the first and second support arms movable along the elongate support element are removable from at least one of a first and second end of the elongate support element, each of the first and second support arms being positionable on the elongate support element such that the coupling element extends beyond at least one of the first and second ends of the elongate support element and the proximal end of the first arm element is positioned over the elongate support element, and wherein each of the first and second support arms also being positionable on the elongate support element such that no portions of the first arm element and second arm element extend beyond the first or second ends of the elongate support element.

17. The stand of claim 16, wherein the object coupling apparatus further comprises a drop support arm apparatus movable along the elongate support element and also removable from at least one of the first and second ends of the elongate support element, wherein the drop support arm apparatus comprises a distal coupling element movable to various positions at one or more elevations above the ground surface that are less than an elevation of the coupling element of either the first and second support arms, the distal coupling element of the drop support arm apparatus being usable to couple the drop support arm apparatus to another portion of the object, wherein the gap defined by the first arm element being offset from the elongate support element is sized such that the drop support arm apparatus is movable along the elongate support element within the gap.

18. The stand of claim 17, wherein the drop support arm apparatus comprises a drop arm portion that extends at least partially along a drop axis substantially vertical to the ground surface, and further wherein the distal coupling element is movable vertically to one or more elevations above the ground surface, movable horizontally along an axis orthogonal to the substantially vertical drop axis, rotatable to one or more positions about the axis orthogonal to the drop axis, and rotatable to one or more positions about the drop axis.

* * * * *